US005824248A

United States Patent [19]

Sweet et al.

[11] Patent Number: 5,824,248

[45] **Date of Patent: *Oct. 20, 1998**

[54] SPINNING POLYMERIC FILAMENTS

[75] Inventors: Gregory Eugene Sweet, Greenville, N.C.; George Vassilatos, Wilmington, Del.

[73] Assignee: E. I. du Pont de Nemours and Company, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 731,541

[22] Filed: Oct. 16, 1996

[51] Int. Cl.[6] ..... D01D 5/092

[52] U.S. Cl. ..... 264/211.14; 264/237

[58] Field of Search ..... 264/211.14, 237

[56] References Cited

U.S. PATENT DOCUMENTS

| | | | |
|---|---|---|---|
| H1275 | 1/1994 | Duncan | 428/357 |
| 3,067,458 | 12/1962 | Dauchert . | |
| 3,336,634 | 8/1967 | Brownley et al. . | |
| 4,156,071 | 5/1979 | Knox | 528/308.2 |
| 4,185,062 | 1/1980 | Luzzato | 264/211.14 |
| 4,687,610 | 8/1987 | Vassilatos | 264/211.14 |
| 4,691,003 | 9/1987 | Sze | 528/308.1 |
| 5,034,182 | 7/1991 | Sze et al. | 264/555 |
| 5,104,725 | 4/1992 | Broaddus | 428/224 |
| 5,141,700 | 8/1992 | Sze | 264/555 |
| 5,250,245 | 10/1993 | Collins et al. | 264/103 |
| 5,288,553 | 2/1994 | Collins et al. | 428/364 |

FOREIGN PATENT DOCUMENTS

| | | |
|---|---|---|
| 216213 | 8/1990 | Japan . |
| 180508 | 8/1991 | Japan . |
| 1 034 166 | 6/1966 | United Kingdom . |
| WO 95/15409 | 6/1995 | WIPO . |

OTHER PUBLICATIONS

Abstract of Japan 2–216,213 (Published Aug. 29, 1990).
Abstract of Japan 3–180,508 (Published Aug. 6, 1991).

*Primary Examiner*—Leo B. Tentoni

[57] ABSTRACT

An improvement is provided in the rapid quenching of melt-spun polymeric filaments, whereby the filaments are cooled by quenching gas that is accelerated along the threadline by being passed through a tube of smaller dimensions with the filaments before they emerge.

3 Claims, 2 Drawing Sheets

SPINNING POLYMERIC FILAMENTS

FIELD OF THE INVENTION

The present invention concerns improvements in spinning polymeric filaments, and more particularly in how such filaments are quenched after they have been extruded from a heated polymeric melt, so they harden and are then wound or otherwise processed, and in the product filaments and yarns therefrom.

BACKGROUND

Most synthetic polymeric filaments are melt-spun, i.e., they are extruded from a heated polymeric melt. This has been done for more than 50 years, since the days of W. H. Carothers, who invented nylon. Nowadays, after the freshly-extruded molten filamentary streams emerge from the spinneret, they are "quenched" by a flow of cooling gas to accelerate their hardening, so they can be wound to form a package of continuous filament yarn or otherwise processed, e.g., collected as a bundle of parallel continuous filaments for processing, e.g., as a continuous filamentary tow, for conversion, e.g., into staple or other processing. The present invention is concerned mainly with improvements in this quenching aspect, and provides improvements in the quenching system and process, and products resulting therefrom.

Mostly, the following description gives details of polyester filament preparation, polyester filaments being the synthetic polymer filaments that are now manufactured commercially in the greatest quantities. The invention is, however, not confined to polyester filaments, but may be applied to other polymers, such as polyamides, e.g., nylon 6,6 and nylon 6, polyolefins, e.g., polypropylene and polyethylene, and including copolymers, mixed polymers, blends, and chain-branched polymers, just as a few examples. Also the term filament is used generically, and does not necessarily exclude cut fibers (often referred to as staple), although synthetic polymers are generally prepared initially in the form of continuous polymeric filaments as they are melt-spun (extruded).

There have been essentially two basic types of quench systems in general commercial use. "Cross-flow quench" has been favored and used commercially by many fiber engineering firms, and involves blowing cooling gas transversely across and from one side of the freshly-extruded filamentary array; this is the sense in which we use the term "cross-flow quench"; much of this cross-flow air passes through and out the other side of the filament array; however, depending on various factors, some of the air may be entrained by the filaments and be carried down with them towards the puller roll which is driven and is usually at the base of each spinning position; cross-flow has generally been favored by many fiber engineering firms as puller roll speeds ("withdrawal speeds", sometimes referred to as spinning speeds) have increased because of a belief that "cross-flow quench" provides the best way to blow the larger amounts of cooling gas that are required as speeds have been increased. Another type of quench is referred to as "radial quench" and has been used by DuPont for commercial manufacture of some polymeric filaments, e.g., as disclosed by Knox in U.S. Pat. No. 4,156,071, and by Collins, et al. in U.S. Pat. Nos. 5,250,245 and 5,288,553; this type of "radial quench" has meant that the cooling gas has been directed inwards through a quench screen system that has surrounded the freshly-extruded filamentary array; such cooling gas normally leaves the quenching system by passing down with the filaments, out of the quenching apparatus; we have made improvements in this type of quench system according to the present invention. Although, for a circular array of filaments, the term "radial quench" is appropriate, the same system can work essentially similarly if the filamentary array is not circular, e.g., rectangular, oval, or otherwise, with correspondingly-shaped surrounding screen systems that direct the cooling gas inwards towards the filamentary array. The present invention is not limited to a quenching system that surrounds a circular array of filaments but can be applied more broadly, e.g., to other appropriate quenching systems that introduce the cooling gas to an appropriately-configured array of freshly-extruded molten filaments in a zone below a spinneret.

In the 1980's, Vassilatos and Sze made significant improvements in the high-speed spinning of polymeric filaments and disclosed these and the resulting improved filaments in U.S. Pat. Nos. 4,687,610 (Vassilatos), 4,691,003 and 5,141,700 (Sze), and 5,034,182 (Sze and Vassilatos). These disclosed gas management techniques, whereby gas surrounded the freshly-extruded filaments to control their temperature and attenuation profiles, the gas velocity being at least 1.5× to about 100× the velocity of the filaments so the air exerted a pulling effect on the filaments. A modification of what Vassilatos taught in U.S. Pat. No. 4,687,610 is discussed hereinafter as we have used such a modification of what Vassilatos taught as controls to show advantages that can be obtained by use of the present invention. As will be clear, our control experiments were not exactly what was taught by Vassilatos, but were modifications of what was taught by Vassilatos.

SUMMARY OF THE INVENTION

According to one aspect of the invention, there is provided in a melt-spinning process of spinning continuous polymeric filaments in a path from a heated polymeric melt in a spinneret to a roll that is driven at a surface speed of at least 500 meters/minute, wherein cooling gas is introduced to freshly-extruded molten filaments in a zone below the spinneret, the improvement that comprises passing the filaments and cooling gas together out of said zone through a tube that is of restricted dimensions and that surrounds the filaments as they cool, and controlling dimensions and location of the tube and amount of gas so that the gas is accelerated but leaves the tube at a speed that is less than the speed of the filaments.

A main reason for restricting the cross-sectional dimensions of the tube (through which the filaments and cooling gas pass together out of the zone below the spinneret where the cooling gas is introduced) is to accelerate the speed of the gas. Contrary to what has been taught in the art, however, the gas should not be accelerated to more than the speed of the filaments.

The length of the tube is preferably sufficient so the filaments harden before they leave the tube, i.e., the filaments preferably leave the tube at the surface speed of said roll that is driven at a speed of at least 500 meters/minute.

The cooling gas is preferably introduced to the freshly-extruded filaments by being blown radially into the zone below the spinneret, and so this preferred embodiment is what is mainly discussed hereinafter but, as has been explained hereinbefore, the invention can be applied more broadly to any other quenching system that introduces cooling gas to an appropriately-configured array of freshly-extruded filaments in the zone into which the filaments are extruded.

According to another aspect of the invention, there are provided new products resulting from and/or obtained by use of our new process. In particular, as will be described hereinafter, by modifying a quench system according to the invention, so the quenching gas is accelerated and passed with the filaments through a tube, but the gas is not accelerated to as high a speed as the filaments, the quenching can be improved and the uniformity of the resulting filaments can be improved. This is surprising. The invention is particularly advantageous for filaments of low dpf, as their uniformity can be improved according to the invention, so that novel filaments can be produced with a combination of low dpf and low denier spread, as will be described hereinafter. Accordingly, there are provided novel continuous filament polyester yarns of elongation to break ($E_B$) about 100% or more and of boil off shrinkage (BOS) about 25% or more, said yarns containing at least 50 filaments, and said filaments being of denier about 3 denier per filament or less, and of denier spread (DS) about 2% or less. Such yarns are partially oriented and suitable draw feed yarns, e.g., for draw-texturing. Preferably the boil-off shrinkage (BOS) is about 40% or more. Preferably the yarns contain at least 100 filaments, and their denier per filament is preferably about 2 or less.

DETAILED DESCRIPTION

Figure 1:
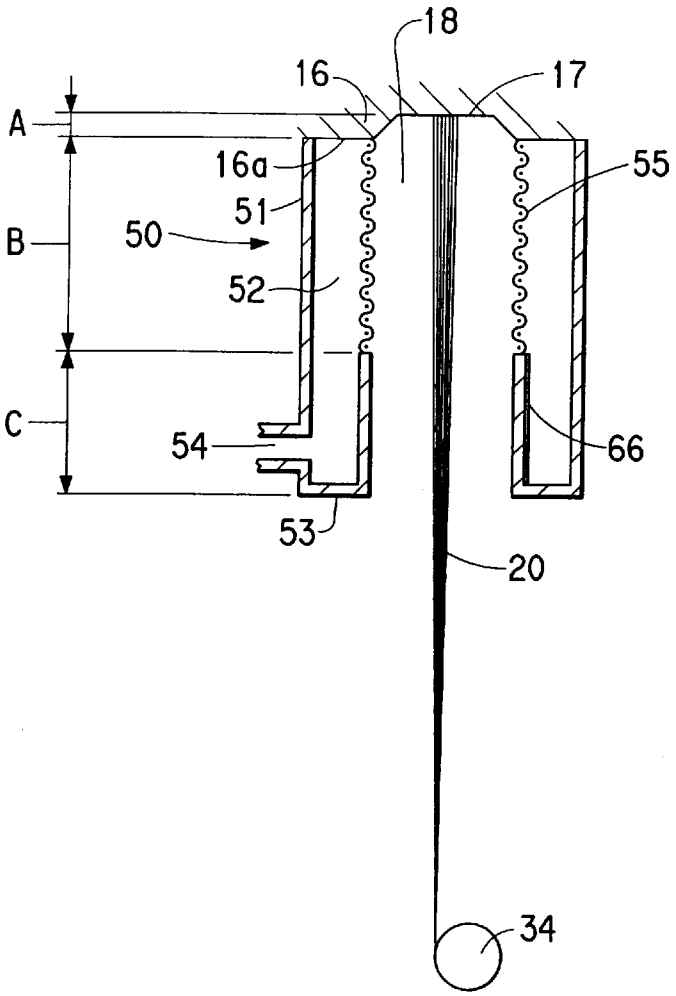
FIG. 1 is a schematic elevation view partially in section of an apparatus that was not according to the invention, but was used as a control for comparison purposes vs. the embodiment shown in FIG. 2, as discussed hereinafter.

As indicated, we have modified what Vassilatos taught in U.S. Pat. No. 4,687,610 and used such modification as a control to show advantages of the present invention. So the quenching system and process used as a control will first be described with reference to FIG. 1 of the drawings, which is broadly similar to that described and illustrated in U.S. Pat. No. 4,687,610, except as mentioned hereinafter. This quenching system used as a control in contrast to Example 1 of the invention includes a cylindrical housing 50 which forms an annular chamber 52 that is supplied with pressurized cooling gas blown in through inlet conduit 54 which is formed in outer cylindrical wall 51 of housing 50. Annular chamber 52 has an annular bottom wall 53 attached to cylindrical inner wall 66, at the lower portion of annular chamber 52, below a cylindrical quench screen system 55 that defines the inner surface for the upper portion of annular chamber 52 and through which the pressurized cooling gas is blown radially inwards from annular chamber 52 into a zone 18 below spinneret face 17 through which zone 18 passes a bundle of filaments 20 which are still molten, having been freshly-extruded from a heated melt in a heated spinning pack 16 through holes (not shown) in spinneret face 17 which is centrally located with respect to housing 50 and is recessed from face 16*a* (of spinning pack 16) onto which housing 50 abuts. Filaments 20 continue from zone 18 out of the quenching system through a tube formed by inner wall 66 that surrounds the filaments, down to puller roll 34, the surface speed of which is termed the withdrawal speed of the filaments 20.

The following dimensions are shown in FIG. 1, as they are shown for the control, e.g., in Table I:

A—Quench Delay Height, being the height of spinneret face 17 above face 16*a;*

B—Quench Screen Height, being the height of cylindrical quench screen system 55 (extending from face 16*a* to the top of inner wall 66); and C—Tube Height, being the height of inner wall 66 which acts effectively as tube 19 surrounding filaments 20 after they pass below the bottom of quench screen system 55 until they pass below the bottom 53 of housing 50.

As will be understood, the total height for the process we used as a control from the spinneret (face) to the tube exit was A+B+C.

Both diameters, the Quench Screen Diameter (extending over the Quench Screen Height) and the Tube Diameter (extending over the Tube Height), for this control were the same, as shown in FIG. 1.

A preferred quenching system and process according to the invention will now be described with reference to FIG. 2 of the drawings, similar reference numerals indicating like elements as in FIG. 1, such as for the heated spinning pack 16, face of spinning pack 16*a* to which housing 50 is attached, spinneret face 17, zone 18, filaments 20, puller roll 34, outer cylindrical wall 51 of housing 50, annular chamber 52, annular bottom wall 53, inlet 54 and cylindrical quench system 55. Proceeding down below cylindrical quench system 55, however, the quenching system and process according to the invention are different from the control shown in FIG. 1 and described above. Proceeding down, the filaments may pass, effectively, through a short tube 71 of the same internal diameter as cylindrical quench system 55, and pass preferably through a tapered section 72, before entering a tube 73 of smaller internal diameter and extending below the bottom 53 of housing 50, the dimensions of the elements being such that filaments 20 are undergoing attenuation as they enter tube 73, and, taking into account the amount of cooling gas blown into inlet 54 and out of tube 73 with filaments 20, the speed of such gas leaving tube 73 is less than the speed of filaments 20 as they leave tube 73. Filaments 20 will preferably have already hardened before they leave tube 73, in which case, when they leave tube 73, their speed will already be the same speed as their withdrawal speed at roll 34.

Figure 2:
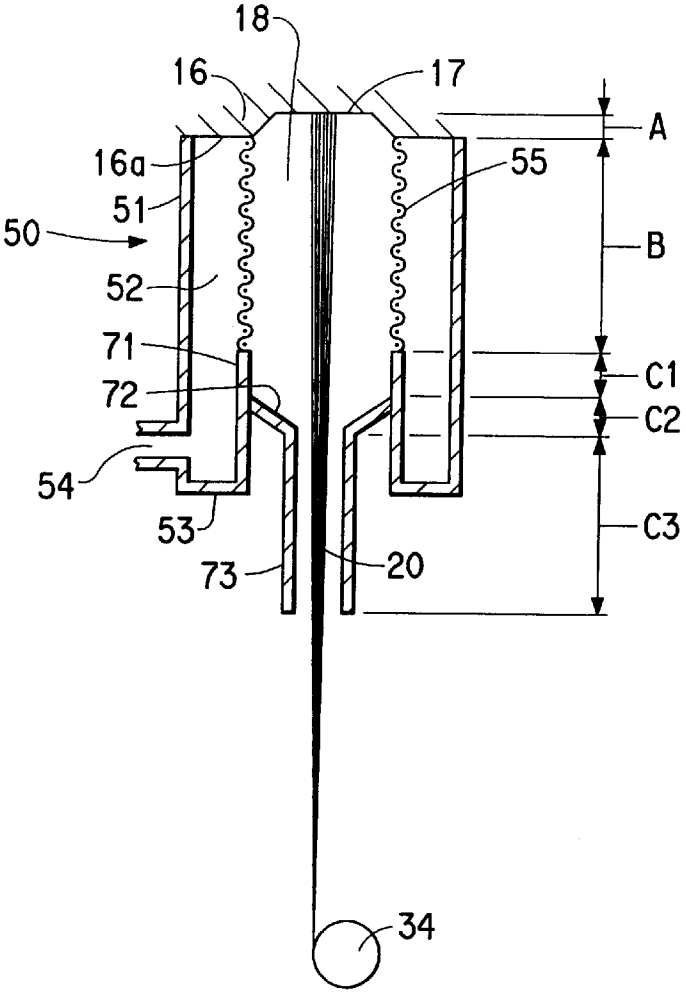
FIG. 2 is a schematic elevation view partially in section of one embodiment for practicing the invention, and as used in Examples 1 and 2 and discussed hereinafter.

In addition to the height dimensions A and B discussed above as being shown in FIG. 1, Table I also lists for FIG. 2:

$C_1$—Connecting Tube Height, being the height of any short tube 71;

$C_2$—Connecting Taper Height, being the height of any tapered section 72;

$C_3$—Tube Height, being in this instance, the height of tube 73 of restricted internal diameter that causes the cooling gas to accelerate out of zone 18.

As will be understood, the total height for the process according to the invention from the spinneret (face) to the tube exit is $A+B+C_1+C_2+C_3$.

As shown in both Figures, filaments 20, after leaving the quench systems, continue down to driven roll 34 which pulls filaments 20 in their path from the heated spinneret so their speed at roll 34 is the same as the surface speed of driven roll 34 (disregarding slippage), this speed being known as the withdrawal speed. As is conventional (but not shown in the drawings) a finish is applied to the solid filaments 20 before they reach driven roll 34. At that point, different types of windup may be used, a 3 roll windup system being preferred for continuous filament yarns, as shown by Knox in U.S. Pat. No. 4,156,071, with interlacing as shown therein, or, for example, a so-called godet-less system, wherein yarn is interlaced and then wound as a package on the first driven roll shown as 34 in FIG. 1, or, for example, filaments are not interlaced nor wound but may be passed as a bundle of parallel continuous filaments for processing as tow, several such bundles generally being combined together for tow-processing.

Figure 3:
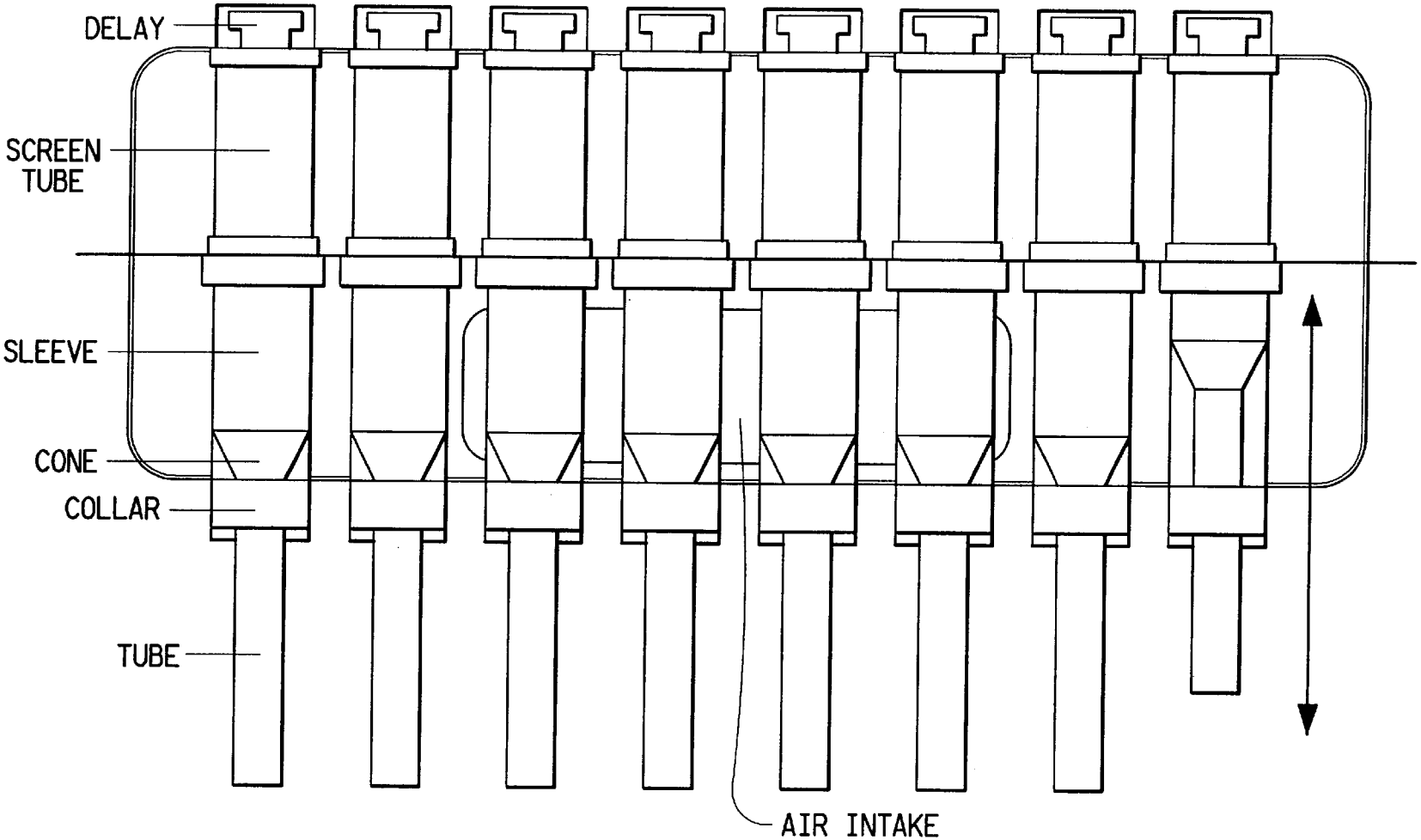
FIG. 3 is a schematic elevation view partially in section of an embodiment as used in Example 3 and discussed hereinafter.

Referring to FIG. 3, a schematic arrangement of eight quenching systems according to the invention is shown, by way of example, within a single diffuser. The various elements are shown on the system at the left, in order, referring to FIG. 2 (and the Tables in the Examples hereinafter), "Delay" corresponding to "Quench Delay Height A" between spinneret face 17 and face 16*a*, "Screen Tube" corresponding to "Quench Screen Height B" extending down to the bottom of cylindrical quench screen system 55 and top of short tube 71, "Sleeve" corresponding to "Connecting Tube Height ($C_1$)" extending down to top of tapered section 72, "Cone" corresponding to "Connecting 60° Taper Height ($C_2$)" extending down to top of tube 73 of smaller internal diameter, and "Tube" corresponding to "Tube Height ($C_3$)", i.e., the tube 73 of smaller internal diameter itself. It will be noted that the latter "Tube" is shown as adjustable, being raised for the system on the right, which provides means for controlling the location of such tubes. Also a tube of different dimensions may be substituted and/or the supply of cooling gas (blown through a common "Air Intake") may be adjusted in volume and/or temperature to adjust the quenching conditions and ensure that the gas speed is accelerated, but accelerated only to less than the speed of the filaments.

We have operated with such an accelerated gas speed of about one quarter to about one half that of the withdrawal speed of the filaments, the gas speed through the tube being easy to calculate from the volume of gas supplied and the cross-section of the tube, and the withdrawal speed of the filaments being easier to measure than the speed of the filaments as they leave the tube, and it is preferred that the filaments have hardened before they leave the tube, so that the filaments are preferably already at or near the withdrawal speed as they leave the tube with the gas at a slower speed than the filaments. The relative speeds of the gas and filaments may be varied according to the results desired, e.g., as little as about 20% to about 60% of the filament speed, or even up to 90% or as much as 95%, if desired, but we have found it important to avoid acceleration of the gas speed to more than the speed of the filaments as both emerge from the bottom of the quenching system, in contrast to suggestions previously in the art.

Thus, according to the invention, the cooling gas is first introduced into the zone below the spinneret where the freshly-extruded filaments emerge as separate streams in molten form from the spinneret through the capillaries. This introduction of the cooling gas may be performed in various ways. For instance, conventional methods of introducing the cooling gas may be used, or new ways may be devised. Whatever method is chosen, the cooling gas is likely to be introduced into the zone with a relatively small component of velocity in the direction of motion of the filaments which are themselves moving slowly away from the spinneret. The cross-sectional area of such zones has conventionally been considerably larger than the cross-sectional area of the array of freshly-extruded filaments. To leave the zone, however, the cooling gas must, according to the invention, enter a tube of restricted cross-sectional area (less than the cross-sectional area of the zone), so the gas must accelerate as it enters and passes down the tube. We believe that this forces the cooling gas into the filamentary array, which probably enhances the cooling effect of this gas on the filaments. Providing a tapered entrance to the tube is preferred. We believe that an appropriately-tapered entrance to the tube smoothes the acceleration of the cooling gas, and avoids turbulence such as could lead to less uniformity along-end. We have used tapered entrances to tubes with taper angles of 30°, 45° and 60° Taper, the optimum taper angle depending on a combination of factors. A tube of 1 inch (2.5 cm) diameter has been found very useful in practice, and a tube of 1.25 inches (3.2 cm) diameter has also been used effectively.

The shape of the tube that is of restricted dimensions need not only be of cylindrical cross-section, but may vary, especially when a non-circular array of filaments is extruded. Thus, for instance, tubes of rectangular, square, oval or other cross-section may be used. The dimensions of the cross-section of such tubes are of importance in calculating the speed of the cooling gas emerging therefrom, in conjunction with the volume of cooling gas that is supplied.

The cooling gas is preferably air, especially for polyester processing, because air is cheaper than other gas, but other gas may be used, for instance steam, especially for nylon, or an inert gas if required because of the sensitive nature of the polymeric filaments, especially when hot and freshly extruded.

The comments in the paragraph immediately preceding this paragraph are conventional to those skilled in this field, as are many other features of spinning and processing polymeric filaments and have been disclosed in the art, including that referred to, so it would be redundant to repeat them here.

Advantages of the invention may be seen in the Examples and further discussion hereinafter. We have found it possible to improve uniformity and/or increase the withdrawal speed without a corresponding reduction in the elongation ($E_B$) or an increase in the draw tension.

The invention is further illustrated in the following Examples which provide comparison with control experiments that were run similarly but not according to the invention. We believe that the air speed was always significantly less than the speed of the filaments as they both left the tube in each of the following Examples according to the invention, although the air speeds were always significantly increased over the air speeds in the corresponding control experiments, as can be seen in each Table.

Most of the fiber properties are conventional tensile and shrinkage properties, measured conventionally, as described in the art cited. "BOS" is for boil-off shrinkage. Relative viscosity is often referred to herein as "LRV", and is the ratio of the viscosity of a solution of 80 mg of polymer in 10 ml of a solvent to the viscosity of the solvent itself, the solvent used herein for measuring LRV being hexafluoroisopropanol containing 100 ppm of sulfuric acid, and the measurements being made at 25° C., as described in Broaddus U.S. Pat. No. 5,104,725 and in Duncan U.S. SIR H1275.

Denier Spread is a measure of the along-end unevenness of a yarn by calculating the variation in mass measured at regular intervals along the yarn. Denier variability is measured by running yarn through a capacitor slot which responds to the instantaneous mass in the slot. The test sample is electronically divided into eight 30 m subsections with measurements every 0.5 m. Differences between the maximum and minimum mass measurements within each of the eight subsections are averaged. The Denier Spread is recorded as a percentage of this average difference divided by the average mass along the whole 240 m of the yarn. Testing can be conducted on an ACW400/DVA (Automatic Cut and Weigh/Denier Variation Accessory) instrument available from Lenzing Technik, Lenzing, Austria, A-4860.

The Draw Tension, in grams, was measured at a draw ratio of 1.7×, and at a heater temperature of 180° C. Draw tension is used as a measure of orientation. Draw tension may be measured on a DTI 400 Draw Tension Instrument, also available from Lenzing Technik. Normally, an increase in the withdrawal speed is accompanied by an increase in the draw tension and a reduction in the elongation, which can be undesirable, whereas we have achieved increases in the withdrawal speed without increasing the draw tension or reducing the elongation, as will be seen in the Examples hereinafter.

EXAMPLE 1

A 125-34 light denier polyester yarn (see Table 1) was spun at 292° C. from poly(ethylene terephthalate) polymer of 21.9 LRV using a quenching system as described hereinbefore and illustrated with reference to FIG. 2, the pertinent processing parameters being shown in Table 1, to give yarn whose parameters are also given in Table 1. The internal diameter of the quench screen 55 was 3 inches (7.5 cm), below which was a connecting tube 71, of the same internal diameter and of height $C_1$, below which was a tapered section 72 of height $C_2$, referred to as "Connecting 60° Taper Height" in Table 1, and connecting to a tube 73 of restricted internal diameter 1 inch (2.5 cm) and of height $C_3$. The "60° Taper" referred to is the 60° angle included in the tapered section, i.e., the tapered surface is inclined at an angle of 30° from the vertical.

For comparison, a control yarn was also spun from similar polymer at 292° C. using a quenching system as described hereinbefore and illustrated with reference to FIG. 1, the pertinent processing and resulting yarn parameters being also shown for comparison in Table 1. For this control yarn, the internal diameters of the quench screen 55 and of the tube 66 below the screen were both 3 inches (7.5 cm), i.e., there was no use of a tube of restricted diameter below the quench screen, so the air speed emerging from the tube was much lower than for the air emerging in the Example according to the invention.

The same amounts of quench air (30 CFM, 14 liters/sec.) were used in Example 1 and for the control. The air was initially at room temperature.

TABLE 1

| PROCESSING PARAMETERS | CONTROL | EXAMPLE 1 |
|---|---|---|
| Quench Heights inches (cm) | | |
| Quench Delay Height A | 1 (2.5) | 1 (2.5) |
| Quench Screen Height B | 8 (20) | 8 (20) |
| Connecting Tube Height ($C_1$) | | 3 (7.5) |
| Connecting 60° Taper Height ($C_2$) | | 2 (5) |
| Tube Heights (C and $C_3$) | 8 (20) | 18 (46) |
| Total Heights (Spinneret-Tube Exit) | 17 (43) | 32 (84) |
| Speeds | | |
| Tube Air Speed, mpm | 187 | 1680 |
| Withdrawal Speed, mpm | 3290 | 4015 |
| Yarn Parameters (3.7 dpf. 4.1 dtex) | | |
| Number Orifices/Filaments | 34 | 34 |
| Denier (dtex) | 127 (141) | 126 (140) |
| Denier Spread, % | 1.43 | 1.15 |

TABLE 1-continued

| PROCESSING PARAMETERS | CONTROL | EXAMPLE 1 |
|---|---|---|
| Draw Tension, grams | 60 | 59 |
| Tenacity, gpd (g/dtex) | 2.6 (2.3) | 2.4 (2.2) |
| $E_B$, % | 127 | 123 |
| BOS, % | 61 | 66 |

It will be noted that the yarn of Example 1 had a surprisingly and significantly better (lower) Denier Spread than did the control, 1.15% vs. 1.43% (which is more than 20% higher than 1.15%). This is a significant advantage derived from use of the invention. We have achieved other properties of both yarns that were comparable. The improvement in Denier Spread was obtained despite the yarn of Example 1 having been spun at a withdrawal speed that was more than 20% faster (4015 vs. 3290 mpm). When, however, another control yarn was spun using the same control quenching system at the withdrawal speed (4015 mpm) used for Example 1, the draw tension of this other control yarn increased to over 150 grams.

By using the same amount of quench air with a tube of restricted diameter (only 1 inch diameter) in Example 1 according to the invention, the speed of the cooling air was accelerated about 9× from less than 200 mpm (in the control) to almost 1700 mpm according to the invention. But this higher air speed was only about 40% of the withdrawal speed of the filaments.

EXAMPLE 2

A similar polyester yarn, but of heavier denier (260-34), was spun using a somewhat similar quench system as in Example 1, the parameters being shown in Table 2 for this Example 2, and for comparison for a control yarn. In Example 2, the filaments were spun from similar polymer at 296° C., whereas the control yarn was spun from polymer at 293° C. 35 CFM (16 liters/sec.) of quench air were used for each yarn.

TABLE 2

| PROCESSING PARAMETERS | CONTROL | EXAMPLE 2 |
|---|---|---|
| Quench Heights,inches (cm) | | |
| Quench Delay Height A | 1 (2.5) | 1 (2.5) |
| Quench Screen Height B | 15 (37.5) | 15 (37.5) |
| Connecting Tube Height ($C_1$) | | 7.5 (19) |
| Connecting 60° Taper Height ($C_2$) | | 2 (5) |
| Tube Heights (C and $C_3$) | 1 (2.5) | 12 (30) |
| Total Heights (Spinneret-Tube Exit) | 17 (43) | 37.5 (94) |
| Speeds | | |
| Tube Air Speed, mpm | 218 | 1960 |
| Withdrawal Speed, mpm | 3570 | 4530 |
| Yarn Parameters (7.6 dpf, 8.5 dtex) | | |
| Number Orifices/Filaments | 34 | 34 |
| Denier (dtex) | 254 (282) | 259 (287) |
| Denier Spread, % | 4.72 | 2.85 |
| Draw Tension, grams | 122 | 121 |

Again, in Example 2, a significant improvement as obtained in uniformity, a lower Denier Spread of 2.85% vs. 4.72% (which is some 65% higher), with comparable draw tensions, and at a significantly higher withdrawal speed, 4530 mpm being more than 25% higher than 3570 mpm. Again, the speed of the cooling air was accelerated about 9× from 218 mpm in the control to 1960 mpm in Example 2 by passing the filaments and cooling air through a tube of restricted diameter, one third of the diameter of the quench screen (the diameter of the lower tube used in the control being the same as for the quench screen).

EXAMPLE 3

A 115-100 polyester yarn (see Table 3) was spun using a quenching system as described hereinbefore and illustrated with reference to FIG. 3, the parameters being shown in Table 3 for this Example 3, and for comparison for a control yarn. In Example 3, the filaments were spun from polymer at 306° C., whereas the control yarn was spun from polymer at 287° C. Despite the higher polymer temperature, we used less quench air (at 70° F., i.e., 21° C.), only 13.5 CFM (6 liters/sec.) in Example 3, i.e., only half as much as the 27 CFM (13 liters/sec.) used for this control yarn.

TABLE 3

| PROCESSING PARAMETERS | CONTROL | EXAMPLE 3 |
|---|---|---|
| Quenching Heights, inches (cm) | | |
| Quench Delay Height A | 3 (8) | 3 (8) |
| Quench Screen Height B | 6.5 (17) | 6.5 (17) |
| Connecting 60° Taper Height ($C_2$) | | 2 (5) |
| Tube Heights (C and $C_3$) | 7.5 (19) | 15 (38) |
| Total Heights (Spinneret-Tube Exit) | 17 (44) | 26.5 (67) |
| Speeds | | |
| Tube Air Speed, mpm | 168 | 748 |
| Withdrawal Speed, mpm | 2610 | 3120 |
| Yarn Parameters (1.15 dpf. 1.3 dtex) | | |
| Number Orifices/Filaments | 100 | 100 |
| Denier (dtex) | 113 (126) | 114 (127) |
| Denier Spread, % | 2.15 | 1.75 |
| Draw Tension, grams | 69 | 66 |
| Tenacity, gpd (g/dtex) | 2.6 (2.3) | 2.7 (2.4) |
| Elongation, % | 129 | 126 |
| BOS, % | 47 | 53 |

Again, in Example 3, a significant improvement was obtained in uniformity, a lower Denier Spread of 1.75% vs. 2.15% (which is more than 20% higher), with comparable draw tensions, and at a significantly higher withdrawal speed, 3120 mpm being some 20% higher than 2610 mpm. The air speed was accelerated between 4× and 5× by passing the air and filaments through the tube of restricted diameter, but the air speed was still only about one quarter of the withdrawal speed of the filaments. This improvement was obtained with only half the volume of cooling air, which was surprising.

EXAMPLE 4

170-200 polyester yarns (see Table 4), i.e., subdenier filaments were spun according to the invention and, for comparison, a control, essentially as in Example 1, except as shown in Table 4; in Example 4, the top of the tube 73 was at the bottom of the quench screen system, i.e., without using any connecting flared section (use of which we believe would improve the results).

TABLE 4

| PROCESSING PARAMETERS | CONTROL | EXAMPLE 4 |
|---|---|---|
| Quench Heights, inches (cm) | | |
| Quench Delay Height A | 1 (2.5) | 1 (2.5) |
| Quench Screen Height B | 8 (20) | 8 (20) |

TABLE 4-continued

| PROCESSING PARAMETERS | CONTROL | EXAMPLE 4 |
|---|---|---|
| Tube Heights (C and $C_3$) | 8 (20) | 18 (46) |
| Total Heights (Spinneret-Tube Exit) | 17 (43) | 27 (69) |
| Speeds | | |
| Tube Air Speed, mpm | 187 | 1680 |
| Withdrawal Speed, mpm | 2560 | 3130 |
| Yarn Parameters (0.85 dpf, 0.94 dtex) | | |
| Number Orifices/Filaments | 200 | 200 |
| Denier (dtex) | 170 (189) | 170 (189) |
| Denier Spread, % | 5.26 | 1.13 |
| Draw Tension, grams | 101 | 98 |

Again, in Example 4, a very significant improvement was obtained in uniformity, a lower Denier Spread of 1.13% vs. 5.26% (which is more than 4× 1.13%), and with a slightly better draw tension, and the withdrawal speed in Example 4, 3130 mpm, was more than 20% higher than 2560 mpm, the withdrawal speed for the control yarn. When another control yarn was spun using the same control quenching system but at the withdrawal speed (3130 mpm) used for Example 4, the draw tension of this other control yarn increased to over 170 grams.

In addition to the above Examples, we have spun polymeric filaments in other experiments with the indicated quench systems and others, and have noted the following over a limited range:

1. In a melt-spinning process of spinning continuous polymeric filaments in a path from a heated polymer melt in a spinneret to a roll that is driven at a surface speed of at least 500 meters/minute, wherein cooling gas is introduced to freshly-extruded molten filaments in a zone below the spinneret, the improvement that comprises passing the filaments and cooling gas together out of said zone through a tube that is of restricted dimensions and that surrounds the filaments as they cool, wherein the top of the tube is spaced up to 64 cm below the spinneret, and controlling dimensions and location of the tube and amount of gas so that the gas is accelerated but leaves the tube at a speed that is less than the speed of the filaments.

2. Decreasing the distance from the face 17 of the spinneret to the top of the tube 73 of restricted dimensions can be used to reduce the draw tension of the filaments, generally to a much lesser extent, i.e., more of a fine-tuning adjustment, again depending on other conditions, as mentioned.

3. Increasing air flow can generally reduce draw tension but also generally increases denier spread, especially if the distance from the face 17 of the spinneret to the top of the tube 73 of restricted dimensions is reduced too much and the tube gets close to the spinneret.

4. Increasing spinning temperatures can also have the effect of reducing the draw tension of the filaments, again depending on other conditions, as mentioned.

The important point to notice is that the use of the present invention provides a simple adjustment to the quenching process by which it is possible to improve the properties desired in the resulting filaments and to make corrections, when needed. We have demonstrated this for withdrawal speeds in the range 3–5 Km/min., because the types of filaments spun at these withdrawal speeds have been produced commercially in very large quantities, so are of considerable commercial importance. We feel rather confident that advantages can be obtained by operating the invention at lower speeds and higher speeds and for different types of filaments and end uses. The efficiency of our quenching system contrasts with prior opinion that believed the most effective quenching could be obtained by blowing as much cooling air as possible through the filamentary array and out the other side away from the filaments, as has been done in cross-flow commercially.

We claim:

1. In a melt-spinning process of spinning continuous polymeric filaments in a path from a heated polymeric melt in a spinneret to a roll that is driven at a surface speed of at least 500 meters/minute, wherein cooling gas is introduced to freshly-extruded molten filaments in a zone below the spinneret, the improvement that comprises passing the filaments and cooling gas together out of said zone through a tube that is of restricted dimensions and that surrounds the filaments as they cool, and controlling dimensions and location of the tube and amount of gas so that the gas is accelerated but leaves the tube at a speed that is less than the speed of the filaments.

2. A process according to claim 1, wherein the filaments leave the tube at said roll speed of at least 500 meters/minute.

3. A process according to claim 1, wherein the cooling gas is introduced to the freshly-extruded filaments by being blown radially into the zone below the spinneret.

* * * * *

UNITED STATES PATENT AND TRADEMARK OFFICE
CERTIFICATE OF CORRECTION

PATENT NO : 5,824,248
DATED : OCTOBER 20, 1998
INVENTOR(S) : GREGORY EUGENE SWEET, GEORGE VASSILATOS

It is certified that error appears in the above-identified patent and that said Letters Patent is hereby corrected as shown below:

Delete the following text at Column 10, Lines 30-43:

"1. In a melt-spinning process of spinning continuous polymeric filaments in a path from a heated polymer melt in a spinneret to a roll that is driven at a surface speed of at least 500 meters/minute, wherein cooling gas is introduced to freshly-extruded molten filaments in a zone below the spinneret, the improvement that comprises passing the filaments and cooling gas together out of said zone through a tube that is of restricted dimensions and that surrounds the filaments as they cool, wherein the top of the tube is spaced up to 64 cm below the spinneret, and controlling dimensions and location of the tube and amount of gas so that the gas is accelerated but leaves the tube at a speed that is less than the speed of the filaments.

Add the following text at Column 10, Lines 30-43:

-- 1. Increasing the length of the tube 73 of restricted dimensions can be used to reduce the draw tension of the filaments; this reduction can be significant, but the effect does depend on other conditions, such as denier per

UNITED STATES PATENT AND TRADEMARK OFFICE
CERTIFICATE OF CORRECTION

PATENT NO : 5,824,248

DATED : OCTOBER 20, 1998

INVENTOR(S) : GREGORY EUGENE SWEET, GEORGE VASSILATOS

It is certified that error appears in the above-identified patent and that said Letters Patent is hereby corrected as shown below:

filament, withdrawal speed, diameter of tube, and other matters mentioned hereinafter.--

Delete existing text at Column 12, Lines 2-5:

"filaments as they cool, and controlling dimensions and location of the tube and amount of gas so that the gas is accelerated but leaves the tube at a speed that is less than the speed of the filaments."

Add the following text at Column 12, Lines 2-5:

--filaments as they cool, wherein the top of the tube is spaced up to 64 cm below the spinneret, and controlling dimensions and location of the tube and amount of gas so that the gas is accelerated but leaves the tube at a speed that is less than the speed of the filaments.--

Signed and Sealed this

Sixth Day of June, 2000

*Attest:*

Q. TODD DICKINSON

*Attesting Officer*

*Director of Patents and Trademarks*